US009829292B2

(12) United States Patent
Brown

(10) Patent No.: US 9,829,292 B2
(45) Date of Patent: Nov. 28, 2017

(54) ARROW WITH NOCK AND HEAD ALIGNMENT

(71) Applicant: Brown Innovations LLC, London, KY (US)

(72) Inventor: Kevin E. Brown, London, KY (US)

(73) Assignee: BROWN INNOVATIONS LLC, London, KY (US)

( * ) Notice: Subject to any disclaimer, the term of this patent is extended or adjusted under 35 U.S.C. 154(b) by 0 days.

(21) Appl. No.: 15/283,825

(22) Filed: Oct. 3, 2016

(65) Prior Publication Data

US 2017/0097215 A1 Apr. 6, 2017

Related U.S. Application Data

(63) Continuation-in-part of application No. 14/993,599, filed on Jan. 12, 2016, now Pat. No. 9,671,202.

(60) Provisional application No. 62/236,884, filed on Oct. 3, 2015.

(51) Int. Cl.

| | |
|---|---|
| ***F42B 6/04*** | (2006.01) |
| ***F42B 6/06*** | (2006.01) |
| ***F42B 6/08*** | (2006.01) |

(52) U.S. Cl.

CPC ..... *F42B 6/04* (2013.01); *F42B 6/06* (2013.01); *F42B 6/08* (2013.01)

(58) Field of Classification Search

CPC ..... F42B 6/02; F42B 6/04; F42B 6/06
USPC ..... 473/578, 586
See application file for complete search history.

(56) References Cited

U.S. PATENT DOCUMENTS

| | | | | | |
|---|---|---|---|---|---|
| 1,794,051 | A * | 2/1931 | Allen | F41B 5/1446 | 261/119.1 |
| 2,125,591 | A * | 8/1938 | Smith | F41B 5/1415 | 124/24.1 |
| 2,467,838 | A * | 4/1949 | Lust | F42B 6/04 | 473/581 |
| 5,273,293 | A * | 12/1993 | Lekavich | F42B 6/04 | 138/173 |
| 5,987,724 | A * | 11/1999 | Kleman | F41B 5/1446 | 269/38 |
| 6,129,642 | A * | 10/2000 | DonTigny | F42B 6/04 | 473/578 |
| 6,595,880 | B2 * | 7/2003 | Becker | F42B 6/04 | 124/44.5 |
| 8,622,855 | B2 * | 1/2014 | Bednar | F41B 5/1415 | 473/578 |
| 8,915,806 | B2 * | 12/2014 | Asherman | F42B 6/04 | 473/578 |

(Continued)

*Primary Examiner* — Alexander Niconovich
(74) *Attorney, Agent, or Firm* — King & Schickli, PLLC

(57) ABSTRACT

An arrow with a non-circular central bore may allow for differential flexural rigidity in the shaft. A non-circular central bore, such as in the form of a bore with a rounded polygon, or more specifically a reuleaux triangle, may also provide self-alighting features when paired with a nock or arrowhead with similar shaped elements. This may allow a user to properly nock an arrow without resorting to manual alignment of the nock and fletchings. The central bore may extend along an entirety of the shaft, or only along a portion of the shaft. The non-circular central bore may be incorporated in an arrow shaft with a round exterior cross section, or with an arrow with a non-circular exterior cross section, such as in the form of a rounded polygon, or more specifically a reuleaux triangle.

17 Claims, 12 Drawing Sheets

(56) References Cited

U.S. PATENT DOCUMENTS

| | | | | |
|---|---|---|---|---|
| 8,951,152 | B1 * | 2/2015 | Huang | F42B 6/06 473/578 |
| 9,140,527 | B2 * | 9/2015 | Pedersen | F42B 6/02 |
| 9,410,774 | B1 * | 8/2016 | Gallo | F42B 6/04 |
| 2015/0018140 | A1 * | 1/2015 | Bednar | F41B 5/148 473/570 |

* cited by examiner

ARROW WITH NOCK AND HEAD ALIGNMENT

This application claims priority to U.S. PROVISIONAL Application Ser. No. 62/236,884, filed Oct. 3, 2015, and is a continuation-in-part of U.S. application Ser. No. 14/993,599, filed Jan. 12, 2016, the disclosures of which are hereby incorporated by reference.

TECHNICAL FIELD

This invention generally relates to a projectile weapon, and more particularly to an arrow with aligning features for the nock and/or the head.

BACKGROUND OF THE INVENTION

In general, it is known to construct an arrow 10 to include a shaft 12, a head 14 attached to or positioned at a front of the shaft 12, fletchings 16 positioned near a rear end of the shaft 12, and a nock 18 on the rear end of the shaft 12, as illustrated in FIG. 1.

Normally, the shaft 12 is round in cross-section. The head 14 may attach thereto and may be configured to strike or pierce a target upon the arrow 10 being fired from a projectile firing device, such as a bow or a crossbow (not pictured). Connection between the head 14 and the shaft is normally accomplished by inserting at least a portion of the head within an aperture, receiver, or otherwise hollow portion of the shaft 12. The connection may be a friction fit, may be threaded, or may include the use of an adhesive.

The arrow 10 may include three fletchings 16, which may be positioned equidistantly around a circumference of the shaft 12. The fletchings 16 are adapted to act as airfoils and stabilize the arrow during flight. The nock 18 may attach to the shaft 12 and may include a bowstring receiver (such as in the form of a notch or groove) for aligning the bowstring with the arrow in order to initiate flight. Connection between the nock 18 and the shaft 12 is normally accomplished via insertion of at least a portion of the nock 18 into the shaft 12. As with the head, the connection between the nock 18 and the shaft 12 may be a friction fit, may be threaded, or may include the use of an adhesive.

Alignment between the nock 18 and the shaft 12 is important, as this alignment is responsible for the relative position of the arrow 10 and the bow when the arrow is shot. If the nock is not properly aligned, then one or more fletchings 16 may contact the bow as the arrow is released, thereby affecting the trajectory and/or speed of the arrow during flight.

Similarly, alignment of the head 14 with the shaft 12 may be important, especially in the case of broadhead, which may include three blades. Specifically, alignment of the blades of the broadhead with the fletchings 16 may lend to a straight trajectory during flight.

Current methods of alignment between the nock and the shaft and/or between the head and the shaft include a simple visual inspection of alignment, or may include some form of a reference point for alignment. For instance, the shaft 12 and/or the nock 18 or head 14 may include a marking or a ridge for indicating an appropriate alignment configuration. However, these manual alignment methods are prone to user error in alignment, and allow for twisting, turning, and working loose of the nock and/or head through normal use.

Accordingly, a need has been identified for an arrow with an improved alignment system which addresses these and other shortcomings of traditional arrows.

SUMMARY OF THE INVENTION

In one embodiment, the present invention generally relates to an arrow with self-aligning features comprising a shaft including a rounded polygonal cross-section and a removable nock including a cross-section matching the rounded polygonal cross-section of the shaft and adapted to engage the shaft along the rounded polygonal cross-section, thereby preventing relative rotation therebetween.

In one aspect, the rounded polygonal cross-section may comprise a reuleaux triangle. The shaft may include an aperture in the shape of a reuleaux triangle, and the nock may include a projection in the shape of a reuleaux triangle adapted for insertion into the aperture.

The arrow may further include a plurality of fletchings attached to the shaft, each of the fletchings positioned at a midpoint between two corners of the rounded polygonal cross-section.

The rounded polygonal cross-section may extend over various lengths of the shaft. For example, it may extend along an entire length of the shaft. Alternately, the cross-section may extend only along an end of the shaft adjacent the engagement of the nock.

In one aspect, the rounded polygonal cross-section may extend along at least a portion of the shaft opposite an end of the shaft adjacent the engagement of the nock. The arrow may further include a head comprising a cross-section matching the rounded polygonal cross-section of the shaft and adapted to engage the portion of the shaft opposite the end of the shaft adjacent the engagement of the nock.

In another aspect, the arrow may include a connector for connecting a head to the shaft, wherein the connector comprises a cross-section matching the rounded polygonal cross-section of the shaft and adapted to engage the portion of the shaft opposite the end of the shaft adjacent the engagement of the nock. The connector may comprise an aperture for engaging the head. In another aspect, the connector may comprise a projection for engaging the head. The connector may include one or more fasteners adapted to lock the head in position relative to the shaft.

In a further embodiment, an arrow with self-aligning features includes a shaft with a first end and a second end, said shaft including a first aperture at the first end and a second aperture at the second end, wherein the first aperture and the second aperture each comprise a reuleaux triangular shape, and a removable nock including a first extension with a reuleaux triangular cross-sectional shape, wherein the first aperture is adapted to receive the first extension, thereby preventing relative rotational movement between the shaft and the nock.

The arrow may further include a head comprising a second extension with a reuleaux triangular cross-sectional shape, wherein the second aperture is adapted to receive the second extension, thereby preventing relative rotational movement between the shaft and the head.

In one aspect, the arrow may further include a connector with a reuleaux triangular cross-sectional shape, wherein the second aperture is adapted to receive the connector, thereby preventing relative rotational movement between the shaft and the connector. The arrow may further include a head adapted to engage the connector, wherein the connector includes a receiver adapted to receive at least a portion of the head, and a fastener adapted to lock the head in position with respect to the connector.

In another aspect, the arrow may further include a head adapted to engage the connector, said head including a receiver and a fastener, wherein the connector includes a second extension, and wherein the receiver is adapted to receive the second extension, and wherein the fastener is adapted to lock the head in position with respect to the connector.

In a further embodiment of the present invention, an arrow with self-aligning features for use with an archery weapon including a string is disclosed. The arrow may comprise a shaft including an end with a reuleaux triangular cross-section, a plurality of fletchings attached to the shaft, at least one of said fletchings comprising an index vane, and a removable nock including a cross-section matching the reuleaux triangular cross-section of the shaft and adapted to engage the shaft along the reuleaux triangular cross-section of the shaft and the nock, and the nock further including a notch adapted to engage the string along a longitudinal length of the notch, wherein engagement of the shaft and the nock establishes a fixed relative angular position between the longitudinal length of the notch and the index vane. In one aspect, the relative angular position between the longitudinal length of the notch and the index vane may be 90 degrees. Alternately, the relative angular position may be zero degrees.

A further embodiment of the present invention relates to an arrow comprising a shaft spanning a longitudinal length from a first end of the shaft to a second end of the shaft, said shaft including an interior bore spanning at least a portion of said longitudinal length, wherein the interior bore includes a non-circular cross sectional shape.

In one aspect, the non-circular cross sectional shape may comprise a rounded polygon. The rounded polygon may be a reuleaux triangle. In another aspect, the rounded polygon may be a rounded pentagon.

The non-circular cross sectional shape may take the form of a triangle or a triangle with rounded corners.

The interior bore may extend from the first end of the shaft to the second end of the shaft. Alternatively, the interior bore may extend along a portion of the shaft less than the longitudinal length of the shaft.

The shaft may further include an exterior cross-sectional shape that is geometrically similar to the cross-sectional shape of the interior bore. In another aspect, the shaft further includes a circular exterior cross-sectional shape.

In another embodiment, an arrow may include a shaft adapted to engage an arrowhead at a first end of the shaft and a nock at the second end of the shaft, said shaft defined by a wall including an exterior surface and an interior surface, said interior surface defining an interior bore within the shaft, wherein the interior bore includes a cross section in the shape of a rounded polygon.

In one aspect, the exterior surface may define a cross section in the shape of a circle. The interior bore may be a reuleaux triangle, a triangle, a triangle with rounded corners, a rounded pentagon, or another rounded polygon with an odd number of sides. The interior bore may extend along the full length of the shaft, or may extend only along a portion of the length of the shaft.

The exterior surface may include at least one mark aligning with a vertex of the rounded polygon. The exterior surface may include at least one mark aligning with a midpoint of a side of the rounded polygon.

In another aspect, the exterior surface may define a cross section in the shape of a rounded polygon. The exterior surface and the interior surface may define geometrically similar rounded polygons in cross section.

DETAILED DESCRIPTION OF THE INVENTION

The description provided below and in regard to the figures applies to all embodiments unless noted otherwise, and features common to each embodiment are similarly shown and numbered.

The device of the current invention relates to an arrow 10 including a shaft 112, at least a portion of the length of the shaft including a cross-sectional shape in the form of a rounded polygon. This rounded polygonal cross-section may be in the form of a reuleaux polygon, such as a reuleaux triangle ("RT"). Alternately, the rounded polygonal cross-section may include any number of sides, such as from six to twelve sides. In one aspect, the shaft 112 may be threadless. It should be understood that while the majority of the embodiments disclosed herein relate to a RT shape, other rounded polygonal shapes may be substituted for the RT shape described herein.

Figure 1:
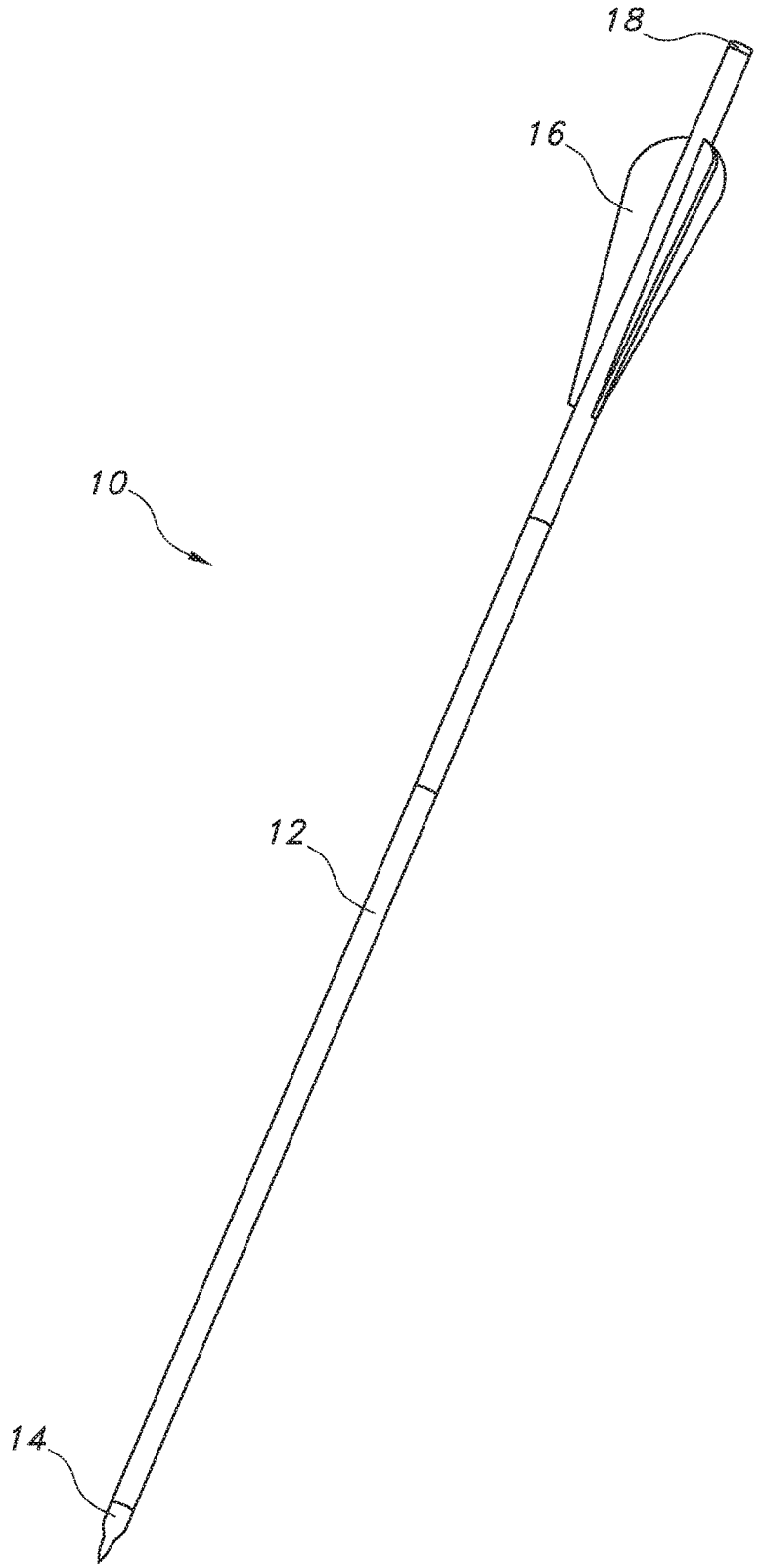
FIG. 1 (PRIOR ART)
FIG. 1 is a general arrow of the prior art.
Figure 2A:
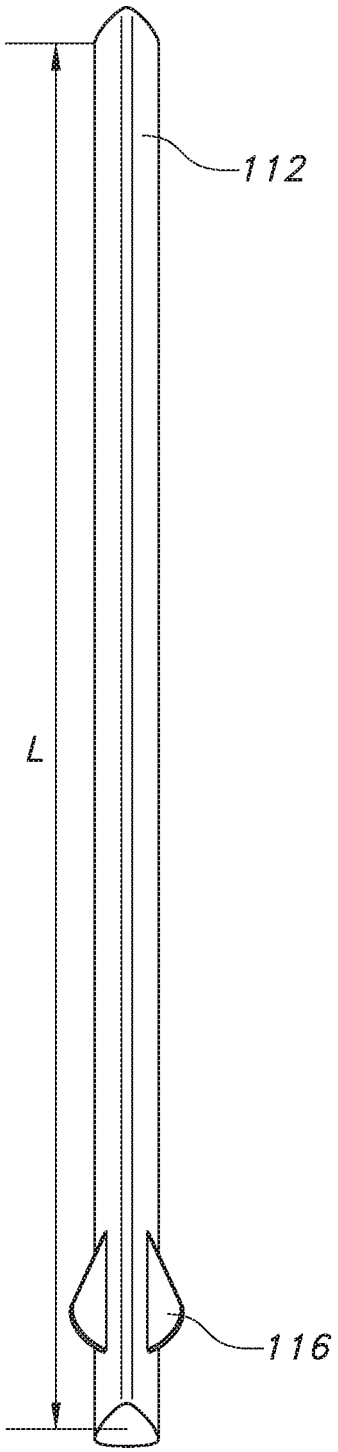
FIGS. 2A-2D illustrate the arrow shaft of the present invention with a reuleaux triangular cross-section.

As illustrated in FIGS. 2A-2D, a length of the shaft including a RT shape may extend along various portions of the shaft 112. In one aspect, the entire length L of the shaft 112 may include a RT cross section, as illustrated in FIG. 2A. As is further illustrated in FIG. 2A, the shaft 112 may include a plurality of fletchings 116 attached to the shaft 112 near a rear end thereof.

Figure 2B:
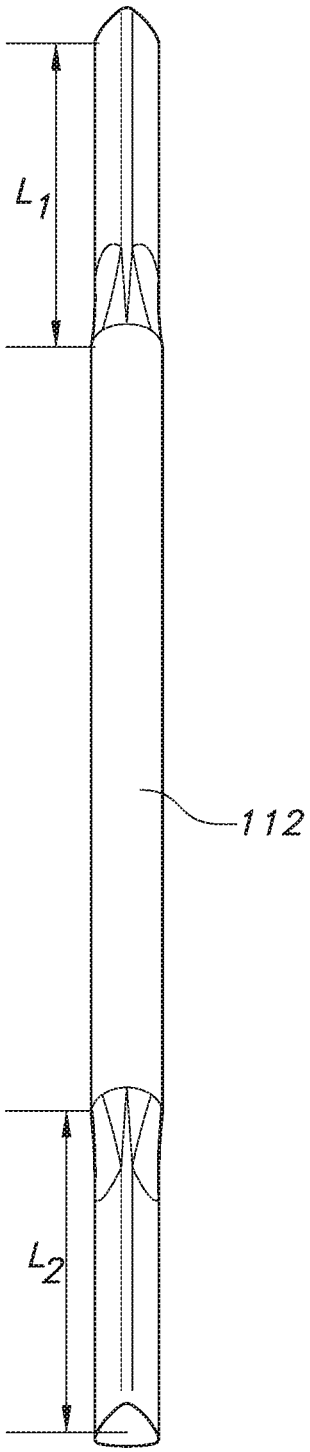

In another aspect, as shown in FIG. 2B, a first length L1 and a second length L2 of the shaft 112 may include the RT cross section. The first length L1 may be located at the front end of the shaft, such as where the head 114 may attach. The second length L2 may be located at a rear end of the shaft, such as where a nock 118 may attach. Between the first length L1 and the second length L2, the shaft may include a different cross-sectional shape, such as retaining a traditional round cross section.

Figure 2C:
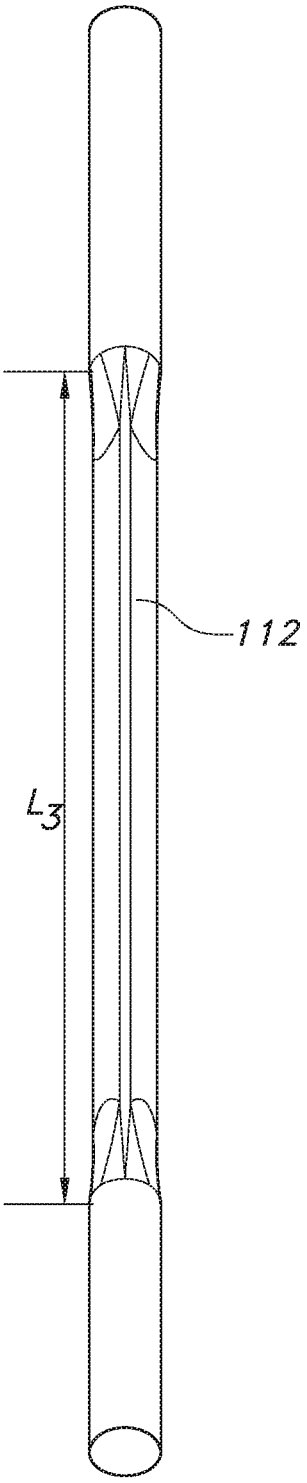

As shown in FIG. 2C, the RT cross section may extend along a third length L3, which extends along a central portion of the shaft 112. The front end and the rear end of the shaft 112 may include a different cross-sectional shape, such as retaining the traditional round cross section.

Figure 2D:
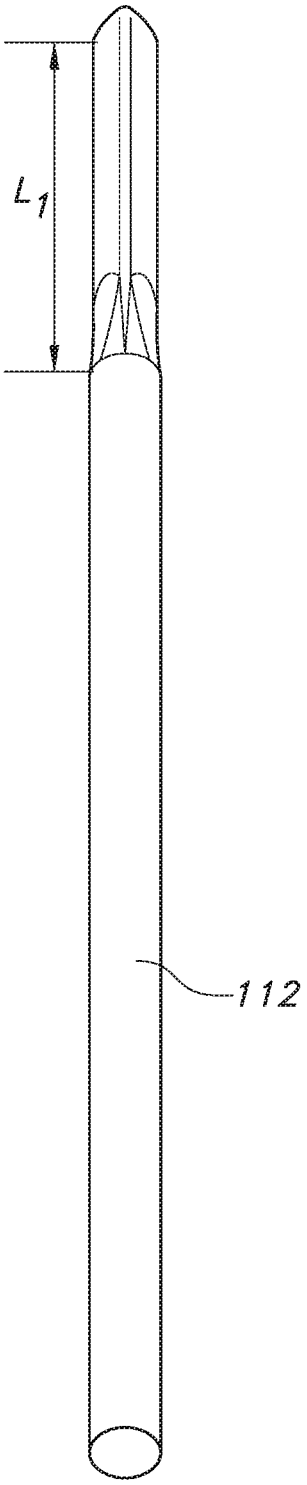

FIG. 2D illustrates that a single end of the shaft 112 may include the RT cross section. The remaining portion of the shaft may include a different cross-sectional shape, such as retaining the traditional round cross section. As illustrated in FIG. 2D, it is the first length L1 on the front end of the shaft 112 which includes the RT shape. Although not illustrated, it is also possible for only the second length L2 of the shaft 112 to include the RT cross section.

In each of FIGS. 2B-2D, the section of the shaft 12 including the RT shape may include a different diameter than the remaining portion of the shaft. For example, the first length L1, the second length L2, and/or the third length L3 may be larger than portion of the shaft 112 with the different cross-sectional shape. Alternately, the first length L1, the second length L2, and/or the third length L3 may be smaller than portion of the shaft with the different cross-sectional shape.

Figure 3A:
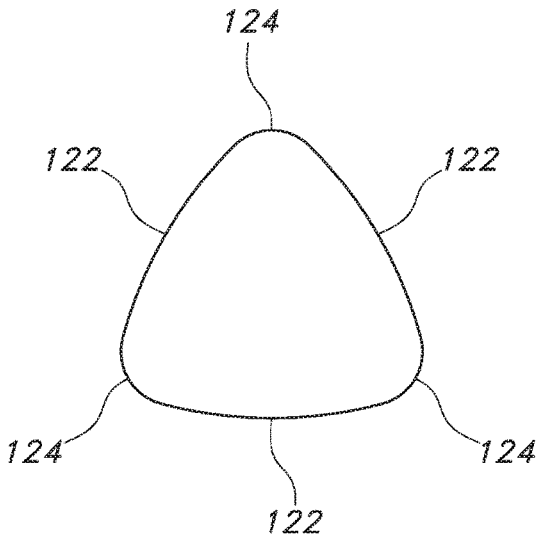
FIGS. 3A-3J illustrate cross-sections of the shaft according to different embodiments.
Figure 3B:
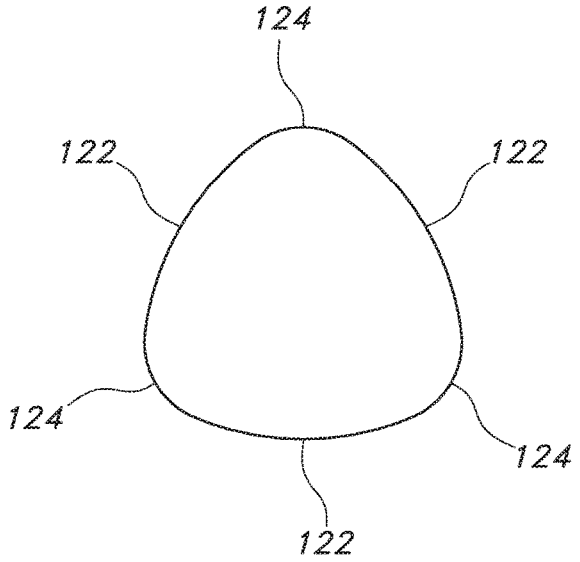
Figure 3C:
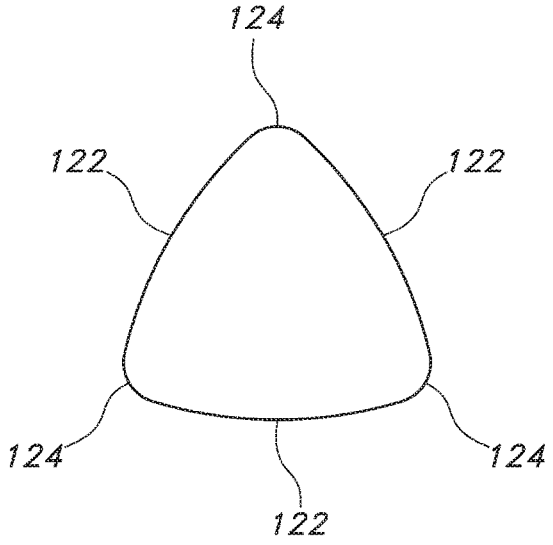

A RT cross-sectional shape 120 is illustrated in FIG. 3A. The cross section is based on an equilateral triangle, and includes rounded sides 122 meeting at rounded corners 124. As illustrated in FIG. 3B, the rounded sides 122 may be more round, while FIG. 3C illustrates that the rounded sides 122 may be less round.

The fletchings 116 may be spread around a perimeter of the cross-section of the shaft, spaced equidistantly from one another. In the case of a RT cross-section, the fletchings may be located at 120 degree intervals around the perimeter of the shaft 112. For instance, the fletchings 116 may be attached to the shaft 112 at a midpoint between the rounded corners 124 on each of the rounded sides 122. In another aspect, the fletchings 116 may be located on each of the rounded corners 124. The longitudinal location of the fletchings 116 may be closer to the rear end than the front end of the shaft 112.

A shaft including the RT shape may be significantly stronger than a conventional round shaft of the same size. Specifically, a RT shaft may have a greater static and dynamic spine strength than a purely round shaft. The flexural rigidity of a RT shaft is also different due to its shape. In the case of a round shaft, the flexural rigidity is generally constant, regardless of the orientation of the arrow. In the case of a RT arrow, with a rounded corner 124 facing up, a RT shaft has a different rigidity (spine strength) with respect to a given force normal to a longitudinal axis of the arrow than with the rounded corner 124 facing down. Multiple spine strengths from one arrow may allow a manufacturer to produce fewer arrows to address the same number of spine strengths desired by a given set of consumers, than is true with arrows with round shafts. Similarly, a single arrow with different flexural rigidity depending on orientation of the arrow (such as with a RT arrow) may give multiple usage options for a given consumer with that single arrow.

Because a RT shaft has a greater flexural rigidity than a round shaft, a RT arrow has less oscillation back and forth when leaving the bow, which will straighten the arrow out faster during flight. This results in a flatter trajectory and straighter arrow at close range targets for a RT arrow than a round shaft arrow. The RT shaft also has greater durability and straightness than a traditional round shaft Eliminating wobble and/or oscillation also improves accuracy. The added rigidity and strength of a RT shaft may also allow for a thinner wall thickness than a rounded shaft, which would lighten the overall weight of the arrow.

The shaft 112 of the present invention may be parallel/straight, tapered, or barreled along the longitudinal axis. The shaft and arrow may be used in association with a recurve bow, a compound bow, a crossbow, or any other weapon capable of firing an arrow. The shaft may be constructed from a variety of different materials such as fiberglass, aluminum, aluminum alloys, graphite, graphite composites, boron, titanium, carbon, carbon composites and the like or combinations thereof. The various embodiments of the arrow shaft may be formed by cold working in a mandrel drawn process. An extrusion method or a pultrusion method may also be used. Another process for forming the arrow of the present invention is to use a conventional round arrow and form or attach the RT portion or portions into it. An example would be to take a round aluminum (or other suitable material) arrow and insert at least a portion of the arrow into a press or mold so that the relevant portion may be pressed or formed into the RT shape. Another process for forming the arrow of the present invention is to use a mandrel in the arrow shaft shape (including a RT portion or portions), wrap it with flexible material, and cure the material to form the shaft.

Figure 3D:
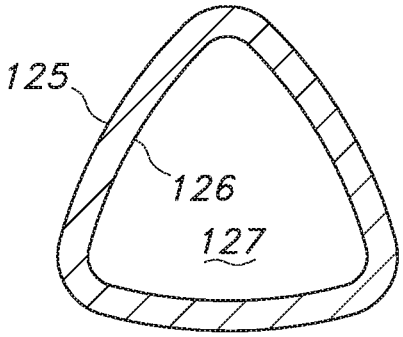
Figure 3E:
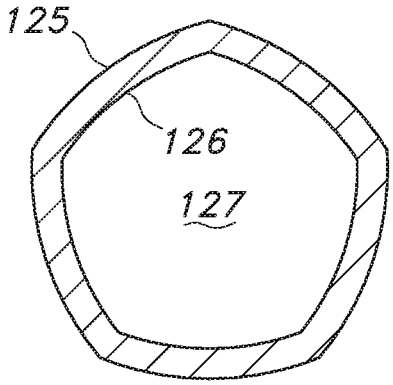
Figure 3F:
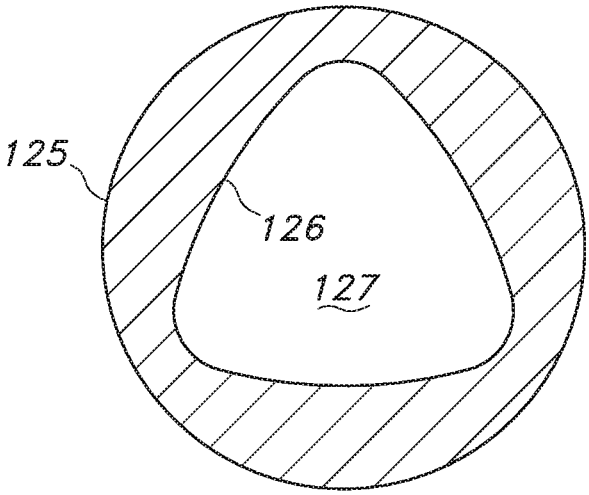
Figure 3G:
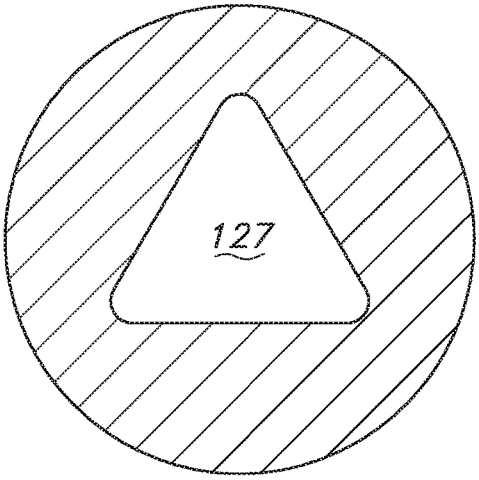
Figure 3H:
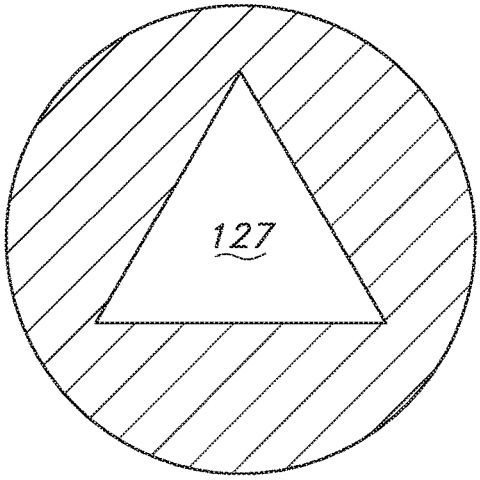
Figure 3I:
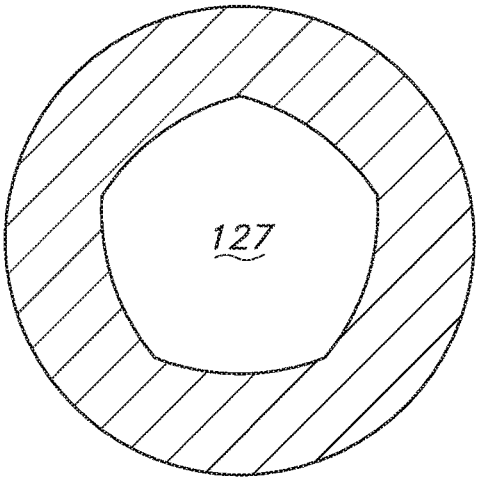
Figure 3J:
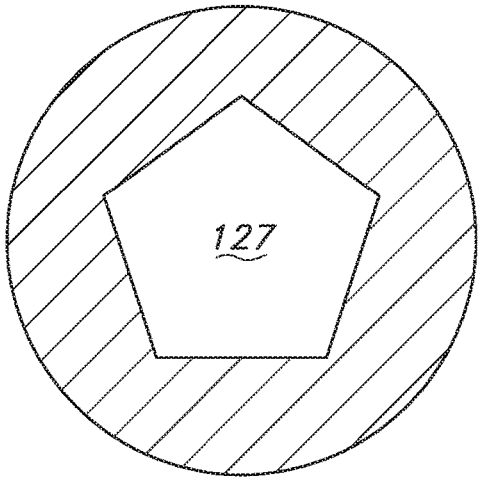

With reference to FIG. 3D, the shaft may include a wall W defined by an outer surface 125 and an inner surface 126. The inner surface 126 may define an interior chamber or an inner bore 127 within the shaft 112. In one aspect, the outer surface 125 and the inner surface 126 may form geometrically similar shapes in cross section. Stated another way, an outer cross section of the shaft 112, such as may be defined by the outer surface 125, and the inner bore 127 may be geometrically similar shapes. As illustrated in FIG. 3D, the outer cross section of the shaft 112 and the inner bore 127 both include a RT shape. As shown in FIG. 3E, the outer cross section of the shaft and the inner bore may take the form of a rounded pentagon. As above, these geometrically similarly shaped outer cross section and inner bores may take the form of any rounded polygon, such as a rounded polygon with an odd number of sides.

As illustrated in FIGS. 3F-3J, the outer diameter of the shaft, such as may be defined by the outer surface 125, may be of a different shape than the bore 127. For example, the outer diameter may be circular in cross section, while the bore 127 may take the shape of a polygon, a rounded polygon, a regular polygon, or another shape geometrically dissimilar from the outer diameter. In the illustrated embodiments, the inner bore 127 may be any of a RT (FIG. 3F), a triangle with rounded corners (FIG. 3G), a triangle, such as an equilateral triangle (FIG. 3H), a rounded pentagon (FIG. 3I), a pentagon, such as a regular pentagon (FIG. 3H), or any other polygon, such as a regular heptagon, with an odd number of sides.

As noted above with respect to the shape of the shaft, a bore 127 with a polygonal, rounded polygonal, regular polygonal, such as is illustrated in FIGS. 3F-3J, may result in a shaft with a variable flexural rigidity or spine strength along one radial direction than in another radial direction. In one aspect, the shaft 112 may include one or more markings, such as numbers, notches, a stamp, or the like, which may indicate a portion of the arrow with the highest flexural rigidity or spine strength.

In any of the above embodiments, the bore 127 may extend either partially along the length of the shaft 112, or along the entire length of the shaft. The bore 127 may extend along the shaft to form an aperture at one or both ends of the shaft 112, such as apertures 130, 160 (see FIGS. 4A-5B).

Figure 4A:
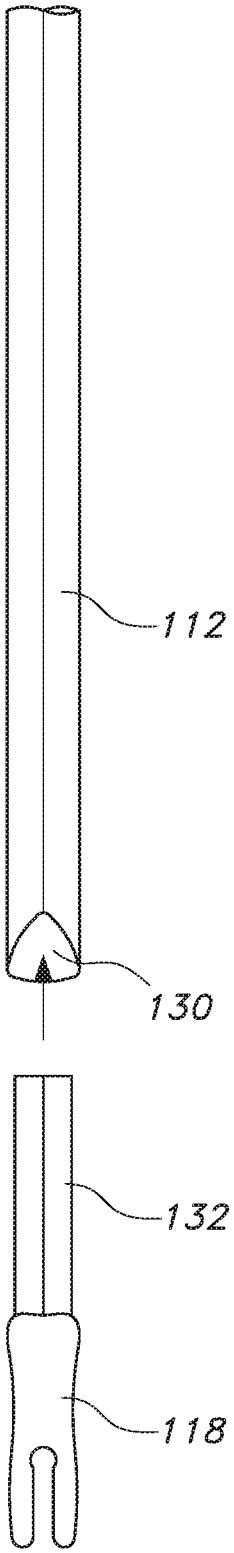
FIGS. 4A-4B illustrate engagement between the nock and the shaft.

In a further aspect of the present invention, a self-locking and aligning knock 118 is disclosed. As shown in FIG. 4A, the nock 118 may be inserted into the shaft 112. In one aspect, the shaft 112 includes an aperture 130 for receiving the nock 118. The aperture 130 may be RT shaped. The nock 118 may include a projection 132, such as a male shank or stud for insertion into the aperture 130. The projection 132 may include a RT cross section for mating with the RT shape of the shaft 112 and/or aperture 130. The projection 132 and/or the aperture 130 may include one or more surface features adapted to assist engagement therebetween. For example, the projection 132 and/or the aperture 130 may include one or more of ridges, grooves, nobs, or other projections/recesses for retaining the projection 132 within the aperture 130. The nock may be constructed out of a durable polycarbonate or the like and/or may comprise a plastic with memory capabilities.

Figure 4B:
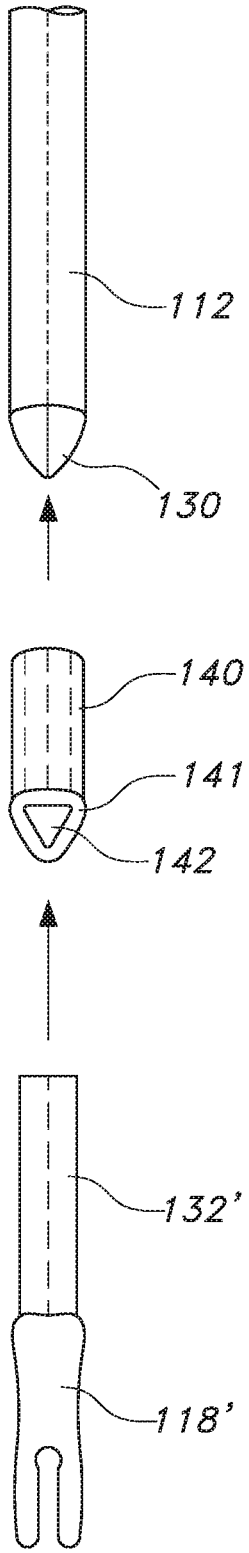

As shown in FIG. 4B, a nock adapter 140 may be provided for attachment to the shaft 112. The nock adapter 140 may be adapted to connect to the shaft 112 in a self-locking manner, and may do so without the use of an adhesive. In one aspect, the nock adapter 140 may be inserted into the aperture 130 of the shaft 112. Like the nock 118, the nock adapter 140 may include one or more surface features adapted to assist engagement between the nock adapter 140 and the aperture 130 of the shaft 112. For example, the nock adapter 140 and/or the aperture 130 may include one or more of ridges, grooves, nobs, or other projections/recesses for retaining the nock adapter 140 within the aperture 130. The nock adapter may be constructed out of a durable polycarbonate or the like and/or may comprise a plastic with memory capabilities, aluminum, brass, or stainless steel.

The nock adapter 140 may include a collar 141 about a perimeter of an end of the nock adapter 140 that does not insert into the aperture 130. Upon engagement with the shaft 112, the collar 141 may be at least partially external to the aperture 130. The collar 141 may include a taper outward toward the perimeter of the shaft 112. This outward taper may be adapted to at least partially deflect a second arrow that may be fired at the nock end of a first arrow, such as a first arrow that has already been embedded in a target.

The adapter 140 may include an aperture 142 for receiving an adapter mating nock 118'. The adapter mating nock 118' may include a projection 132' such as a male shank or stud for mating with the aperture 142. The projection 132' and the aperture 142 may both include a similar cross-sectional shape, such as a RT (or other rounded polygon).

In either embodiment of FIG. 4A or 4B, once inserted into the RT shaft 112, the nock 118 (or adapter mating nock 118') will not twist and turn like the conventional round arrow and nock, specifically because of the unique mating RT (or other rounded polygonal) shapes. Once locked into one of three rotational positions (depending on arrow rest selection), the mated nock 118 and shaft 112 will not rotate with respect to one another. Stated another way, the RT shape associated with both the nock 118 (or the adapter mating nock 118') and the shaft 112 (or the adapter 140) provides a locking feature to prevent relative rotation. This allows for alignment of the nock in relation to the arrow shaft and/or an index vane (or odd colored fletching). For example, the RT shape of the nock 118 (or the adapter mating nock 118') and the shaft 112 (or the adapter 140) may lock the nock 118 in a position such that the string receiver or notch may run perpendicular to the index vane. Such a configuration may assure that the bow string will run perpendicular to the index vane for proper alignment with a recurve bow. Alternately, the notch of the nock may be fixed to align with the index vane, creating a zero degree relative angular position between the notch and the index vane, such as for use with a compound bow, or a bow with a fall-away arrow rest.

Proper and fixed alignment of the present invention is different from a conventional round nock (such as a press-in nock) and shaft, which is prone to twisting, turning and loosening over time, even in the presence of an adhesive. Conventional round nock and shaft configurations that are prone to misalignment may result in the arrow fletchings undesirably rubbing a portion of the bow (such as the arrow rest), and may cause an inaccurate flight path. The locked and aligned nock 118 and shaft 112 of the present invention may result in the fletchings 116 (which are fixed to the shaft 112) consistently being positioned in a desirable relative position with the bow string, and therefore a desirable relative position with respect to the bow.

In addition, the present invention may allow for alignment of a head 114 with a shaft 112 and/or fletchings 116 of the arrow. The head 114 may take the form of a point (e.g. a target point, a bullet point, a combo point, a field point, a judo point, a blunt point, or a bludgeon point) or a broadhead. In the case of a point with a RT shape, alignment to match the three rounded sides of the shaft 112 may be problematic with a conventional threaded insert or a conventional threaded point. Similarly, alignment of the blades of a broadhead with the sides of the shaft 112 and/or the fletchings 116 may be problematic with a conventional threaded insert or conventional threaded broadhead.

Figure 5A:
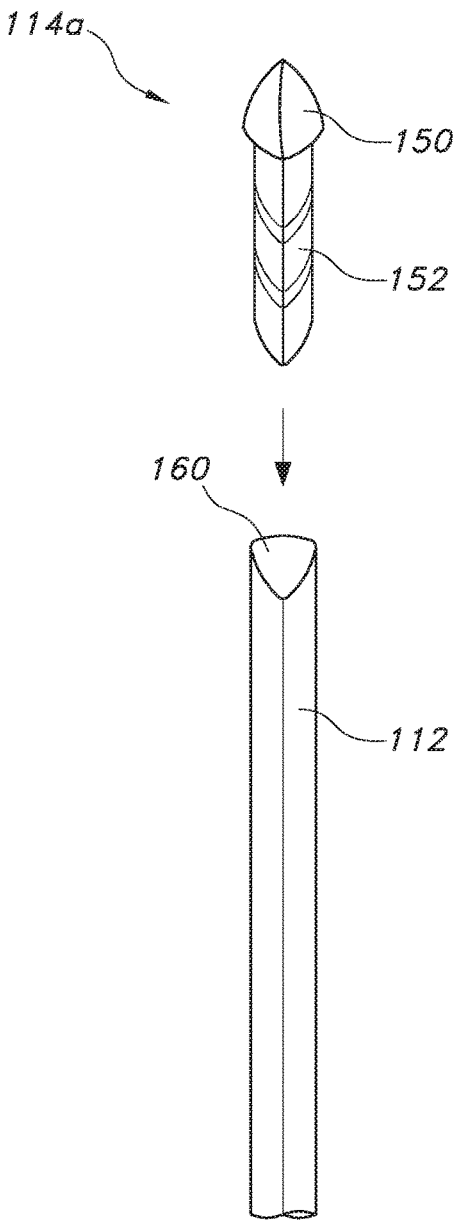
FIGS. 5A-5B illustrate engagement between an arrow head and the shaft.
Figure 5B:
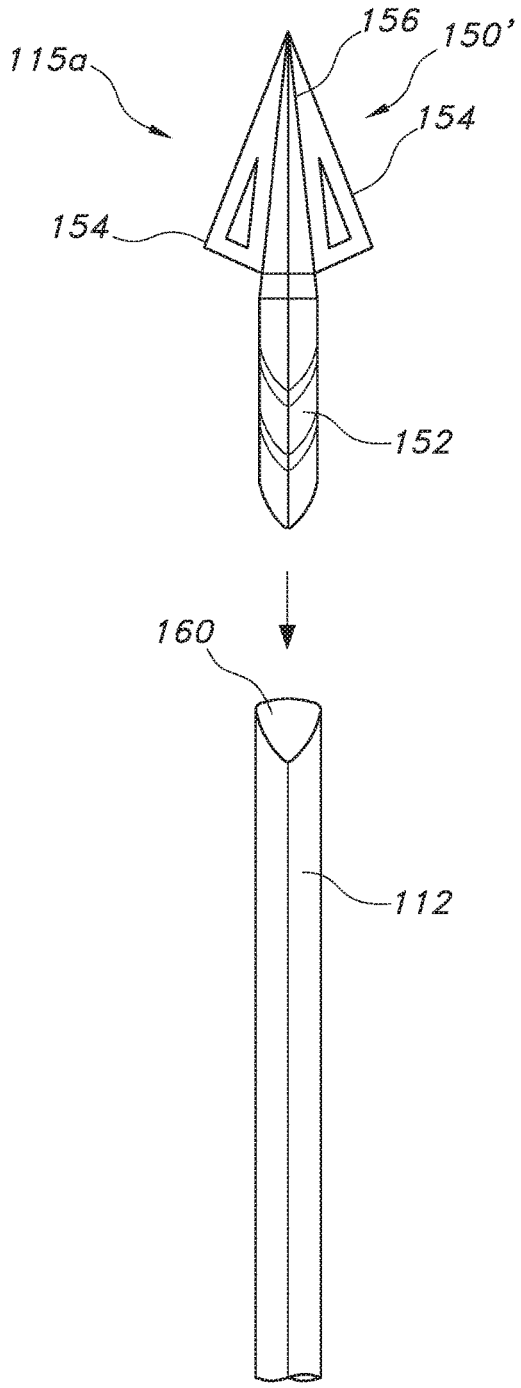

In one aspect of the present invention, the head 114 is configured for insertion directly into the shaft 112. For example, a first point 114*a* may be provided comprising a single body including both a tip 150 and arrow insert 152, as illustrated in FIG. 5A. Similarly, FIG. 5B illustrates first broadhead 115*a* comprising a single body including both a tip 150' and arrow insert 152. The arrow insert 152 may be threadless. The tip 150' of the first broadhead 115*a* may include one or more blades 154 and a ferrule 156. In either embodiment of FIG. 5A or 5B, the insert 152 may comprise a shank or stud. The insert 152 may include the RT cross-sectional shape so as to fit within an aperture 160 of the shaft 112. In either embodiment of FIG. 5A or 5B, at least a portion of the first point 114*a* or the first broadhead 115*a* may comprise a RT shape in cross section to match the shaft 112. In one aspect, an adhesive may be provided for attaching the first point 114*a* or the first broadhead 115*a* to the shaft 112. The head may be constructed of steel, stainless steel, titanium or other suitable material.

In another aspect, the head 114 may be adapted to engage a receiver 170 associated with the shaft 112. The receiver 170 may include a cross-section matching the cross-section of the shaft 112. For example, if the shaft were round, then the receiver would be round. In the case of a RT (or other rounded polygon) shaft, the receiver 170 may also be a RT (or other similarly shaped rounded polygon). In one aspect, the receiver 170 may include a taper to account for an arrow head with a different diameter than the shaft 112. For example, if the head were larger in cross-section than the shaft, then the receiver 170 may include an outward taper to provide a smooth transition from the smaller shaft to the larger head.

Figure 6A:
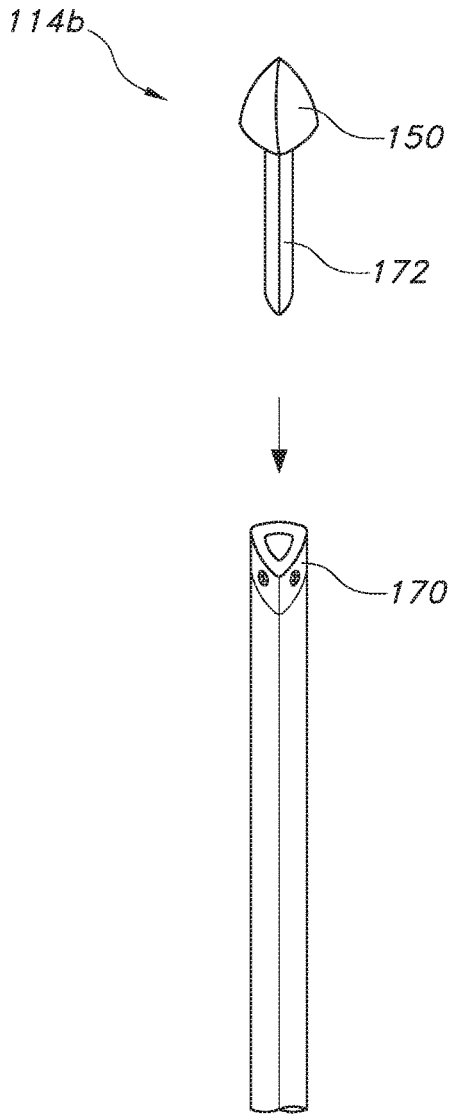
FIGS. 6A-6B illustrate engagement between an arrow head and the shaft with the use of a connector.
Figure 6B:
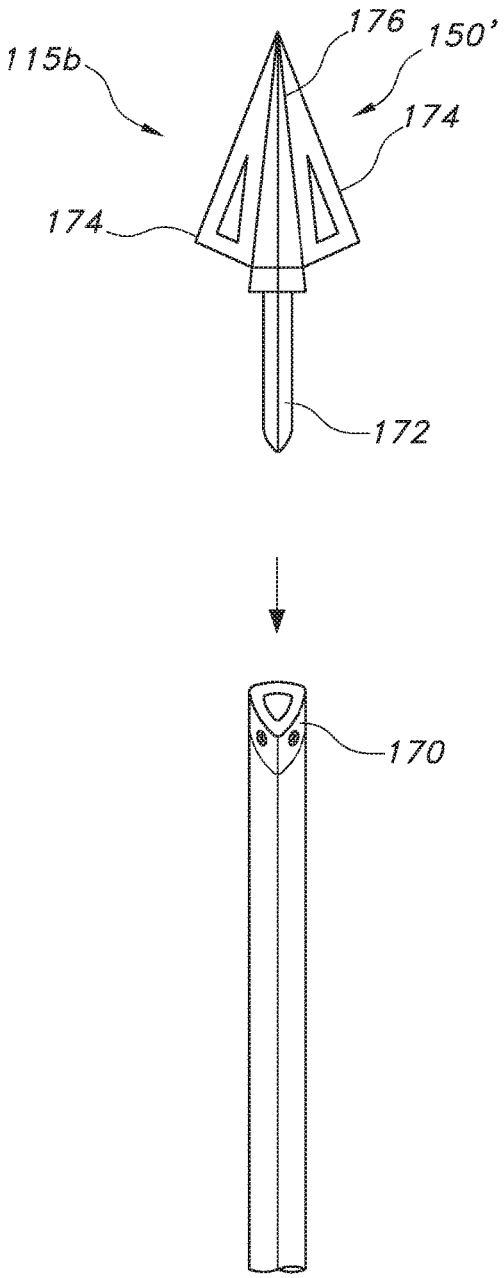

As illustrated in FIG. 6A, a second point 114*b* may be provided as a single body, including a tip 150 and an extension 172. Similarly, FIG. 6B illustrates a second broadhead 115*b* comprising a single body including a tip 150' and extension 172. The tip 150' may include one or more blades 174 and a ferrule 176. The extension 172 may be configured to connect to or mate with the receiver 170. For example, the receiver 170 may include an aperture 184 for engaging the extension 172. The aperture 184 may lead to a channel for receiving the extension 172.

In one aspect, the extension 172 may be in the form of a shank or stud. The extension 172 may be threadless. In a further aspect, the extension 172 may have a RT cross section, another rounded polygonal cross-section, a triangular cross section, or may be round. The aperture 184 may include the same cross sectional shape as the extension 172 to ensure an accurate mated connection. The extension 172 may be adapted to frictionally engage the aperture 184 of the receiver 170. As illustrated in FIGS. 6A and 6B, the extension 172 may include knurling and/or grooves or ridges for engaging the aperture 184 of the receiver 170.

With further reference to FIG. 6A, second point 114*b* may include a RT cross section to match a RT cross section of the shaft 112. Specifically, the tip 150 may include a RT cross section. Similarly, with reference to FIG. 6B, the second broadhead 115*b* may include a RT cross section to match a RT cross section of the shaft. Specifically, the ferrule 176 which includes a RT cross section. In one aspect, the RT cross section of either the second point 114*b* or the second broadhead 115*b* may include a RT cross section that increases in size along a longitudinal direction from tip to base. Alternately, the second point 114*b* or the second broadhead 115*b* may have a cylindrical cross section.

Figure 7:
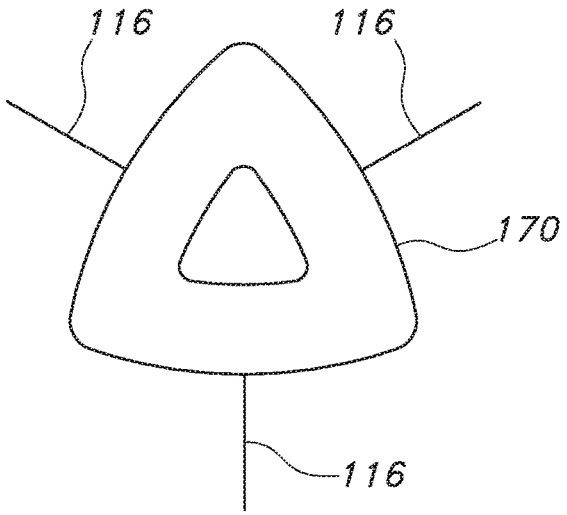
FIG. 7 is a cross section of the arrow with fletchings.

FIG. 7 illustrates a plan view of the shaft 112 of FIGS. 6A and 6B, with fletchings 116 equally spread around the RT cross section. A cross section of any of the second point 114*b* or the second broadhead 115*b* may be adapted to align with the RT cross section of the shaft 112. The size of the cross section of the second point 114*b* or the second broadhead 115*b* may be the same as the size of the cross section of the receiver 170 at the point at which the receiver 170 meets the second point 114*b* or the second broadhead 115*b*.

Figure 8:
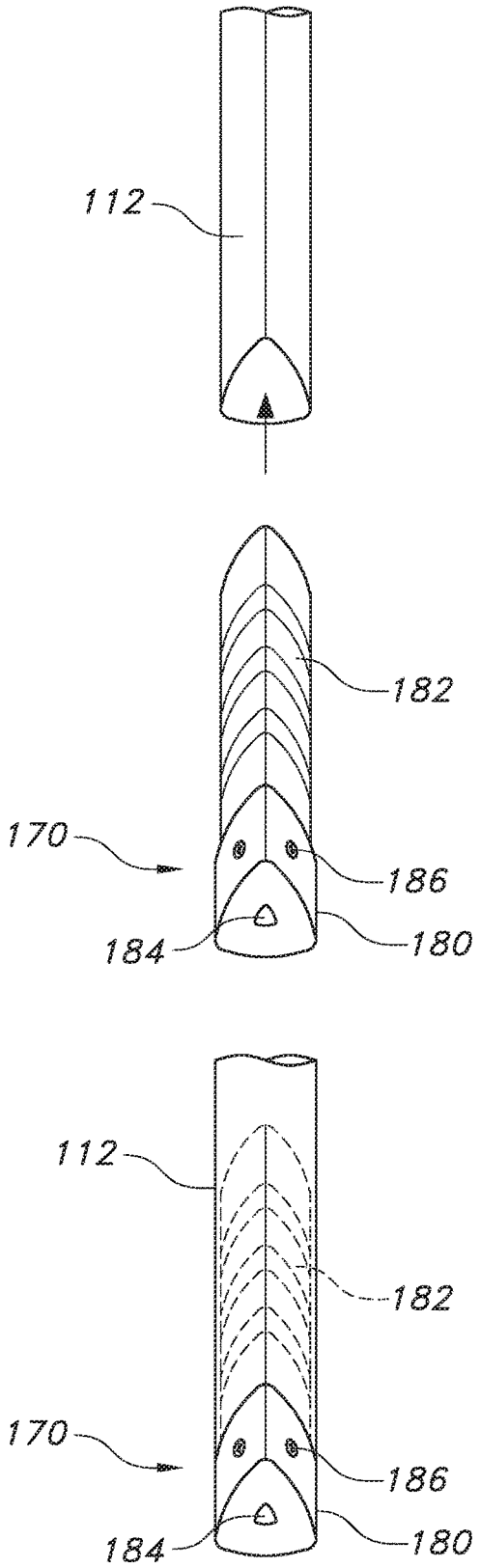
FIG. 8 illustrates the engagement between a link for connecting the arrow head and the shaft.

As shown in FIG. 8, the receiver 170 may be configured for insertion into the shaft 112. The receiver 170 may include a collar 180 and an insertion portion 182. The collar 180 may include an outward taper, such as for engaging a head with a different cross sectional size than the shaft. The insertion portion may include a RT cross section and may be configured to be inserted into the shaft 112. The receiver 170 may be configured to frictionally engage the shaft. For example, the insertion portion 182 may include knurling, grooves, recesses, ridges, or other surface formations for engaging an inner surface of the shaft 112. An adhesive may be used to retain the insertion portion 182 within the shaft 112.

In one aspect, the collar 180 may include one or more fasteners 186, such as adjustable set screws. The set screws may be configured to retain the extension 172 within the receiver 170 upon actuation thereof. For instance, the second point 114*b* or the second broadhead 115*b* may be inserted into the aperture 184, and the set screws tightened to secure the extension 172. In one aspect, the set screws may be allen head set screws and may be adjusted with a hex or allen key. This engagement may allow for alignment and secured fixed positioning of the head 114, the shaft 112, the fletchings 116, and the nock 118.

In the case of the extension 172 and the aperture 184 being triangular, of a RT cross section, of another rounded polygonal cross section, or any other shape that prevents relative rotation between engaged elements, this configuration allows for automatic alignment between similarly shaped features. In the case of a round extension 172 and aperture 184, the head 114 may be rotated relative to the shaft, and fasteners 186 may be used to secure the head 114 in place.

Figure 9:
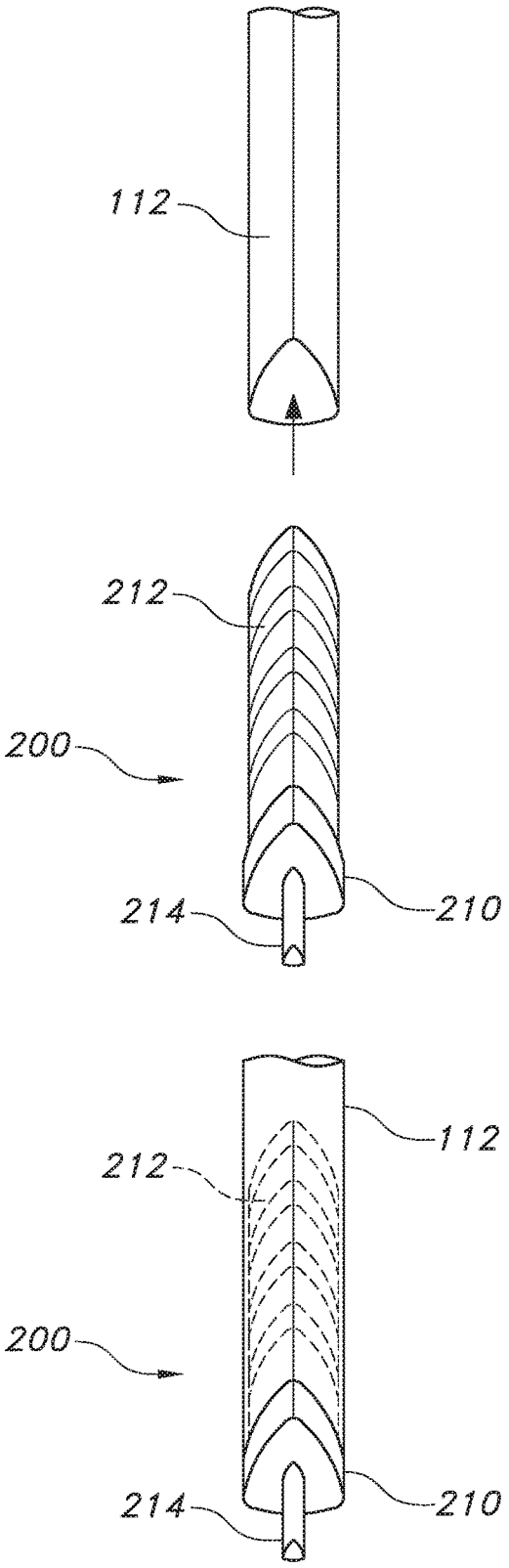
FIG. 9 illustrates the engagement between an alternate link for connecting the arrow head and the shaft.

In another embodiment, an insertable link 200 may be provided for connecting a head 114 to the shaft 112, as illustrated in FIG. 9. The link 200 may include a cross-sectional shape that matches that of the shaft 112. For example, the link and shaft may both be round, or may both include a RT or other polygonal cross-section.

In one aspect, the link 200 may include a collar 210 and an insertion portion 212. The collar 210 may include a taper for engaging a head 114 of a different cross sectional size than the shaft. The insertion portion 212 may include a RT cross section and may be configured to be inserted into the shaft 112. The link 200 may be configured to frictionally engage the shaft. For example, the insertion portion 212 may include knurling, grooves, recesses, ridges, or other surface formations for engaging an inner surface of the shaft 112. An adhesive may be used to retain the insertion portion 212 within the shaft 112.

The collar 210 of the insertable link 200 may include a protruding extension 214, such as a stud or shaft. The extension 214 may have a RT cross section, a triangular cross section, or a round cross section. In one aspect, the extension 214 may include knurling and/or grooves.

Figure 10A:
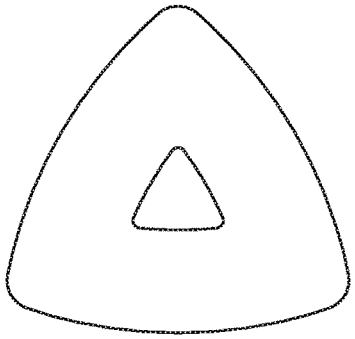
FIGS. 10A and 10B are plan views of different embodiments of a collar associated with the link of either of FIG. 8 or 9.
Figure 10B:
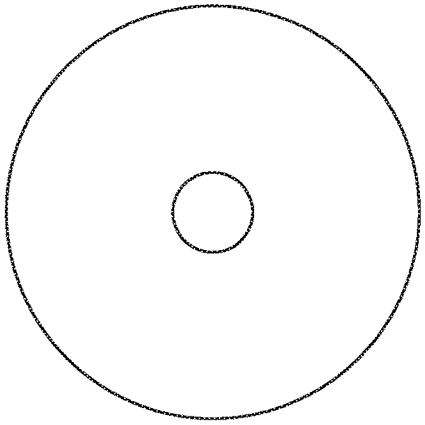

With reference to FIG. 10A, a plan view of the collar 180 (or 210) is illustrated. The collar of FIG. 10A is illustrated as having a RT cross section, but the cross section may be round, as illustrated in FIG. 10B. The round cross section may be used with traditionally round arrow shafts, or with a shaft that includes a round cross section at the head end of the shaft. The cross section of the collar may be the same size as the cross section of the shaft. Alternately, the cross section of the collar may be larger than the cross section of the shaft.

Figure 11A:
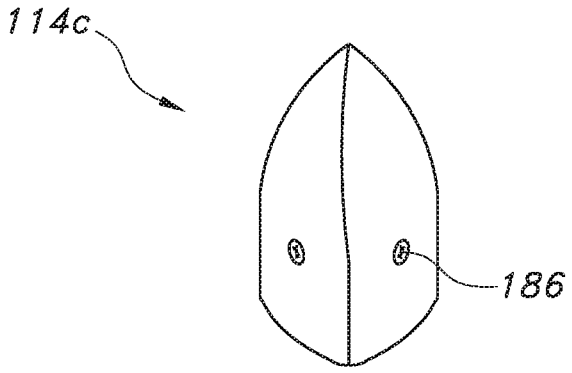
FIGS. 11A and 11B illustrate arrow heads for use with the link of FIG. 9.
Figure 11B:
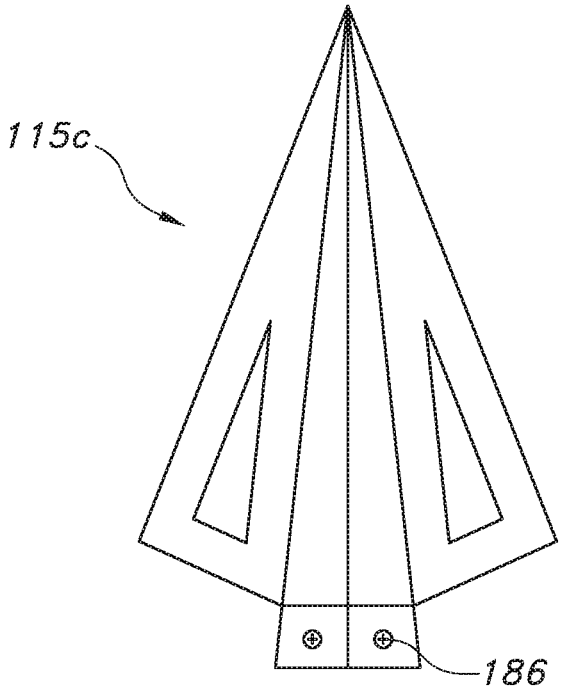

As illustrated in FIGS. 11A and 11B, a third point 114*c*, third broadhead 115*c*, or other head 114 may be adapted to engage the extension 214 for attachment to the shaft 112. For example, the third point 114*c* or the third broadhead 115*c* may include an aperture for receiving the extension 214. The aperture may include a cross-sectional shape to match that of extension 214 of the link 200. The third point 114*c* or the third broadhead 115*c* may be aligned with the shaft 112. The third point 114*c* or the third broadhead 115*c* may include one or more fasteners 186, such as set screws. These fasteners may be used to secure the head on the extension 214, once it has been attached.

The receiver 170 or the link 200 may be constructed of steel, aluminum, stainless steel, brass or the like. In one aspect, the receiver 170 or the link 200 may be weighted and/or may be constructed in a variety of weights. The weight and strength of an insert such as receiver 170 or link 200 may add weight to the front of the arrow that is not present in conventional inserts. This allows for adjustment of "front of center" (FOC) balance position.

The improved arrow system of the current invention allows for near perfect alignment of the arrow shaft with the nock, fletchings and points. This allows for lockable alignment of the nock with the shaft and offers tunability of the points to the arrow shaft. A conventional insert or nock insert used with a conventional round shaft is glued in place and then usually reheated so the nock or hunting point can be rotated to align with the arrow shaft and fletchings. This poses a problem with carbon arrows. Carbon arrows may not be heated because of damage to the carbon fibers. While heating the arrows enables the inserts to be rotated within the arrow shaft it also can reduce the strength of the shaft and the glue creating poor connections between the insert and arrow. The shape of the RT arrow shaft and the adjustable insert of the present invention as well as the unique shape knock solves this issue. The arrow shaft also allows for different flexural rigidity which will cut down the production of many shaft sizes.

While the invention has been described with reference to specific examples, it will be understood that numerous variations, modifications and additional embodiments are possible, and all such variations, modifications, and embodiments are to be regarded as being within the spirit and scope of the invention. Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. An arrow with self-aligning features for use in connection with an arrow head, said arrow comprising:

a shaft spanning a longitudinal length from a first end of the shaft to a second end of the shaft, said shaft including an interior bore spanning at least a portion of said longitudinal length, wherein the interior bore includes a rounded polygonal cross sectional shape; and a removable nock including a rounded polygonal nock cross-section matching the rounded polygonal cross sectional shape of the interior bore and adapted to engage and directly contact the cross section of the interior bore, thereby preventing relative rotation therebetween based on engagement of the matching rounded polygonal interior bore cross section with the rounded polygonal nock cross-section.

2. The arrow of claim 1, wherein the rounded polygon is a reuleaux triangle.

3. The arrow of claim 1, wherein the rounded polygon is a rounded pentagon.

4. The arrow of claim 1, wherein the rounded polygonal cross sectional shape comprises a triangle with rounded corners.

5. The arrow of claim 1, wherein the interior bore extends from the first end of the shaft to the second end of the shaft.

6. The arrow of claim 1, wherein the interior bore extends along a portion of the shaft less than the longitudinal length of the shaft.

7. The arrow of claim 1, wherein the shaft further includes an exterior cross-sectional shape that is geometrically similar to the cross-sectional shape of the interior bore.

8. The arrow of claim 1, wherein the shaft further includes a circular exterior cross-sectional shape.

9. An arrow with self-aligning features comprising:

a shaft defined by a wall including an exterior surface and an interior surface, said interior surface defining an interior bore within the shaft, wherein a first portion of the interior bore includes a cross section in the shape of a rounded polygon; and a removable nock including a nock extension with a rounded polygonal cross sectional shape matching the rounded polygonal shape of the first portion of interior bore, wherein the first portion of the interior bore is adapted to receive the nock extension, thereby preventing relative rotational movement between the shaft and the nock based on the matching of the rounded polygonal cross-sectional shape of the nock extension with the rounded polygonal shape of the first portion of the interior bore.

10. The arrow of claim 9, wherein the exterior surface defines a cross section in the shape of a circle.

11. The arrow of claim 10, wherein the cross section of the interior bore is a reuleaux triangle.

12. The arrow of claim 10, wherein the cross section of the interior bore is a triangle with rounded corners.

13. The arrow of claim 10, wherein the cross section of the interior bore is a rounded pentagon.

14. The arrow of claim 10, wherein the exterior surface includes at least one mark aligning with a vertex of the rounded polygonal cross section of the interior bore.

15. The arrow of claim 10, wherein the exterior surface includes at least one mark aligning with a midpoint of a side of the rounded polygonal cross section of the interior bore.

16. The arrow of claim 9, wherein the exterior surface defines a cross section in the shape of a rounded polygon.

17. An arrow comprising:

a shaft spanning a longitudinal length from a first end of the shaft to a second end of the shaft, said shaft including a circular exterior cross-section;

an interior bore in a fixed rotational position with respect to the circular exterior cross-section, said interior bore spanning at least a portion of said longitudinal length, wherein the interior bore includes a non-circular cross section that defines a convex shape;

wherein the shaft is integrally formed in one piece of solid material.

* * * * *